US006175081B1

(12) United States Patent
Hsieh

(10) Patent No.: US 6,175,081 B1
(45) Date of Patent: Jan. 16, 2001

(54) STRUCTURE OF A SIGNAL TRANSMISSION LINE

(76) Inventor: Wen Lung Hsieh, 4F, No. 1&3, Lane 94, Tsao-Di-Wei. Sheng-Keng, Taipei Hsien (TW)

( * ) Notice: Under 35 U.S.C. 154(b), the term of this patent shall be extended for 0 days.

(21) Appl. No.: 09/321,108

(22) Filed: May 27, 1999

(30) Foreign Application Priority Data

Nov. 20, 1998 (TW) ..... 87219245

(51) Int. Cl.[7] ..... H01B 7/08
(52) U.S. Cl. ..... 174/117 F; 174/69
(58) Field of Search ..... 174/117 F, 117 FF, 174/117 A, 113 C, 131 A, 69

(56) References Cited

U.S. PATENT DOCUMENTS

Re. 31,197 * 4/1983 Cocco ..... 174/117 F X
2,998,840 * 9/1961 Davis ..... 174/117 F
3,823,253 * 7/1974 Walters et al. ..... 174/69
4,090,763 * 5/1978 Congdon et al. ..... 174/113 C X
4,683,349 * 7/1987 Takebe ..... 174/69
4,861,947 * 8/1989 Altermatt et al. ..... 174/113 C
4,975,543 * 12/1990 Saunders ..... 174/69
5,500,489 * 3/1996 Shah et al. ..... 174/117 FF X
5,516,986 * 5/1996 Peterson et al. ..... 174/113 C
5,711,116 * 1/1998 Hasan ..... 52/58

* cited by examiner

*Primary Examiner*—Kristine Kincaid
*Assistant Examiner*—Chau N. Nguyen
(74) *Attorney, Agent, or Firm*—Rosenberg, Klein & Lee

(57) ABSTRACT

An improved structure of a signal transmission line is formed by a plurality of cables, and the material of the cables is polyamide or nylon. The cables are tightly wound with copper wires with good conductivity. Furthermore, an insulator covers the outer surfaces of the cables and copper wires. The material of the insulator is a nylon elastomer. The signal transmission line has a flat and bendable configuration. Since the material of the cables is polyamide or nylon with high tension-resistance, good flexibility and high heat-tolerance is obtained. Therefore, the signal transmission line is able to serve as a telephone wire or serves to transfer signals between computers or other communication devices.

1 Claim, 4 Drawing Sheets

STRUCTURE OF A SIGNAL TRANSMISSION LINE

BACKGROUND OF THE INVENTION

The present invention relates to an improved structure of a signal transmission line, wherein the material of the cable fibers is DU-PONT KEVLAR (polyamide) or nylon, besides, the cables are tightly wound or twisted by copper wires with good conductivity. The material of the cables is DU-PONT KEVLAR or nylon with high tension-resistance, good flexibility and high heat-tolerance. Therefore, the signal transmission line is not easily broken and the signals can be transferred at any time. Therefore, the defect that a prior art signal transmission line is easily broken is improved. Besides, the cables of the signal transmission line are tightly wound and twisted by copper wires, so that the copper wires are densely arranged. Therefore, when the signal transmission line is wound or bent, no gap is formed between copper wires and the signal transmission line has a more preferred flexibility and softness, thus the signal transmission line is more easily wound. Furthermore, the signal transmission line is easier to be welded or pressed into a terminal without breaking.

With reference to FIG. 4, a prior art signal transmission line 20, such as that used in the receiver and transmitter connected to a telephone, or a transmission line used in notebook computer, is illustrated. The transmission line 20 is formed by a plurality of cables 7. The material of the cables 7 is nylon. A copper foil 8 with good conductivity is tightly wound on the cables 7 and a layer of insulator 9 encloses the outer surface of the cables 7. The material of the insulator 9 is nylon and the enclosed signal transmission line 10 has a flat and curled shape.

However, in the prior art transmission line 20, when a copper foil 8 winds the cables 7, since the copper foil 8 has a flat shape, when the transmission line 20 is curled, gaps will generate between different copper foils 8. Thus, it is needed to wind the copper foil on the cables 7 twice. Moreover, the transmission line 20 has no sufficient softness, so that the transmission line as a poor flexibility and is not easily curled. Meanwhile, during manufacturing of the copper foil 8, the copper wires need to be pressed by a roller so as to form as a flat plate. Therefore, the manufacturing process is complicated and the resistance thereof is enlarged. As a result, poor signal transmission is induced.

SUMMARY OF THE INVENTION

Accordingly, the object of the present invention is to provide an improved structure of a signal transmission line, wherein the signal transmission line is formed by a plurality of cables, the material of the cables is DU-PONT KEVLAR or nylon, besides, the cables are tightly wound or twisted by copper wires with good conductivity, furthermore, a layer of insulator covers the outer surfaces of the cables, the material of the insulator is a nylon elastomer (PEBAX). The signal transmission line has a flat and bendable configuration. The material of the cables is DU-PONT KEVLAR or nylon with high tension-resistance, good flexibility and high heat-tolerance. Therefore, the signal transmission line is able to serve as a telephone wire or serves to transfer signals between computers or other communication devices. Therefore, the signal transmission line is not easily broken and the signals are transferred at any time. As a consequence, the prior art defect, such as using a copper foil as material which is easily broken, is improved.

Another object of the present invention is to provide an improved structure of a signal transmission line, wherein the cables of the signal transmission line are tightly wound and twisted by copper wires, so that the copper wires are densely arranged. Therefore, when the signal transmission line is wound or bent, no gap is formed between cooper wires and the signal transmission line has a more preferred flexibility and softness. Thus, the signal transmission line is more easily wound. Furthermore, the signal transmission line is more easily welded to or pressed into a terminal without breaking.

A further object of the present invention is to provide an improved structure of a signal transmission line, wherein since the copper wires are used directly, there is no need for further finishing to form a flat copper foil. Thus, the whole cost is reduced and the conductivity of the copper wires is improved while the resistance of the wire is stable, so as to have a good conductivity and transmission effect.

The present invention will be better understood and its numerous objects and advantages will become apparent to those skilled in the art by referencing to the following drawings in which:

DETAILED DESCRIPTION OF THE PREFERRED EMBODIMENT

Figure 1:
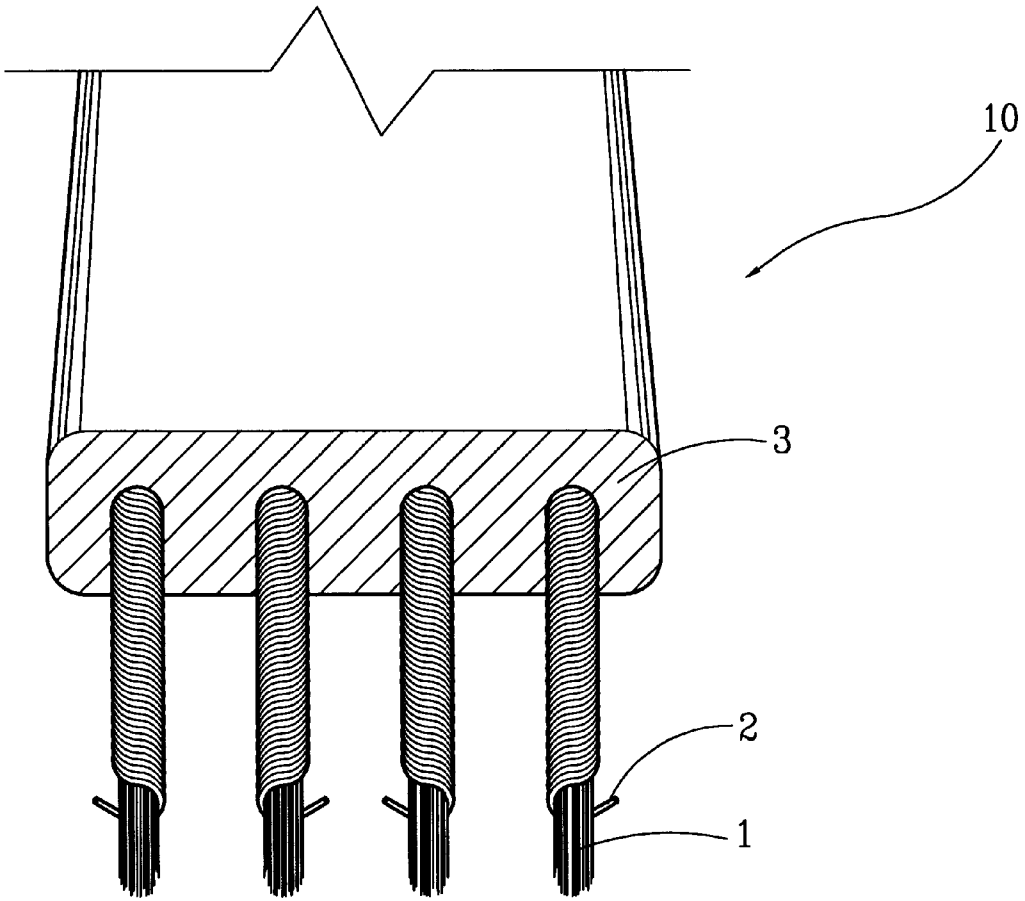
FIG. 1 is a perspective view, partially cut away, of the signal transmission line according to the present invention.

With reference to FIG. 1, an improved structure of a signal transmission line according to the present invention is illustrated. The signal transmission line 10 is formed by a plurality of cables 1. In the present invention, four cables 1 are arranged. The material of each cable 1 is DU-PONT KEVLAR or nylon with high tension-resistance, good flexibility and high heat-tolerance. Besides, copper wires 2 with good conductivity are wound around the cables 1, so that when the signal transmission line 10 is wound, no gap is formed between copper wires 2.

In the present invention, a layer of insulator 3 encloses the cables 1. The material of the insulator 3 is PEBAX, a nylon elastomer. By the insulator 3 protecting the cables 1 from being affected by outside forces, the signals can be transferred freely. The enclosed signal transmission line 10 has a flat shape and is bendable. Moreover, two ends of the signal transmission line 10 are fixedly installed with respective signal plugs 11.

Figure 2:
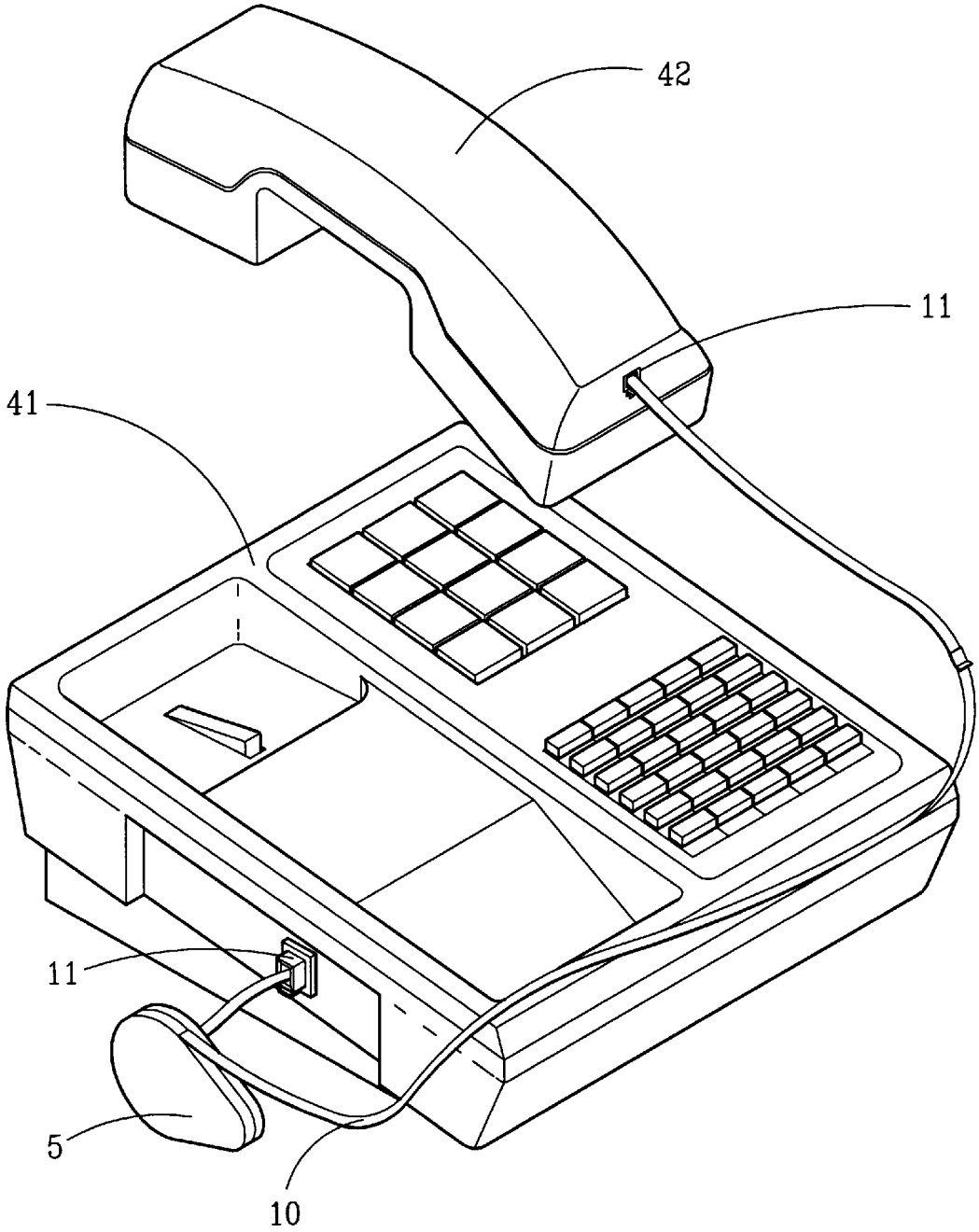
FIG. 2 is a schematic view showing the signal transmission line of the present invention installed to a telephone.

Referring to FIG. 2, the signal transmission line 10 serves as a telephone wire or serves to transfer signals between computers or other communication devices. In a preferred embodiment according to the present invention, the signal plugs 11, at two ends of the signal transmission line 10, are inserted into a transmitter 41 and a receiver 42. The signal transmission line 10 is received within a container 5.

Figure 3:
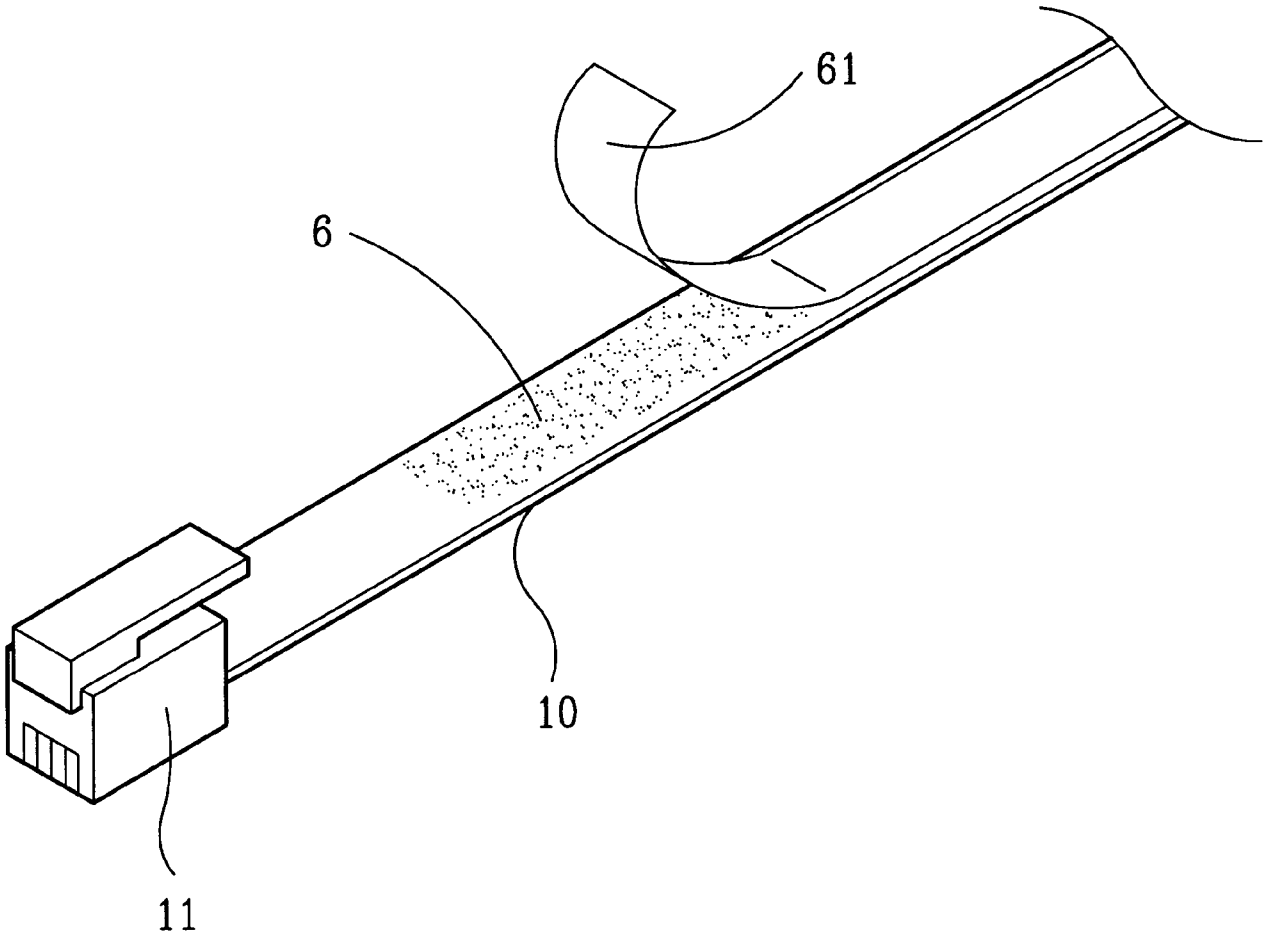
FIG. 3 is a schematic view showing the signal transmission line of the present invention adhered with a double face tape.
Figure 4:
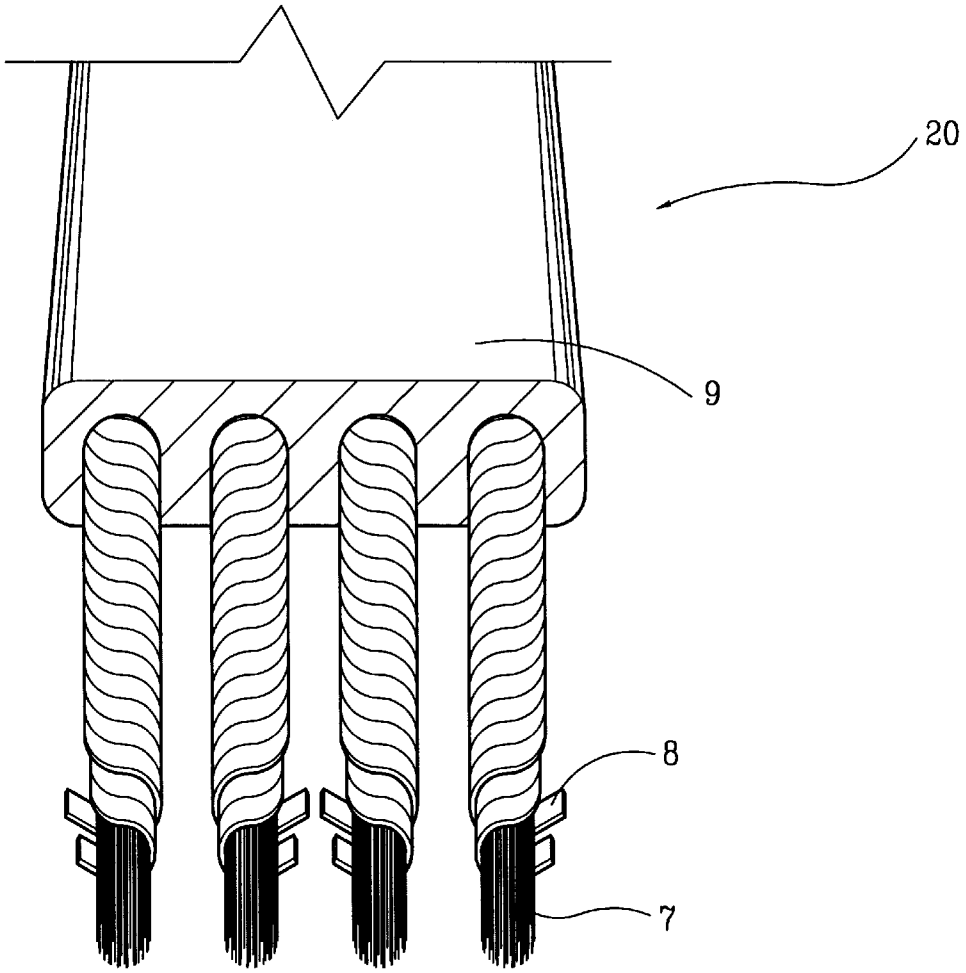
FIG. 4 PRIOR ART
FIG. 4 is a perspective view, partially cut away, of a prior art signal transmission line.

Referring to FIG. 3, a double face tape 6 is adhered to the signal transmission line 10. When the signal transmission line 10 is to be fixed, the paper 61 on one surface of the double face tape 6 is torn away. Thereby, the signal transmission line 10 can be fixed to a desired position.

In the present invention, the material of the cable 1 is DU-PONT KEVLAR or nylon with high tension-resistance, good flexibility and high heat-tolerance. Therefore, the signal transmission line 10 is not easily broken and the signals are transferred at any time. Therefore, the defect of the prior art signal transmission line 20 being easily broken is improved. Besides, the cables 1 of the signal transmission line 10 are tightly wound and twisted by copper wires 2, so that the copper wires 2 are dense. Therefore, when the signal transmission line 10 is wound or bent, no gap is formed between the copper wires 2 and the signal transmission line 10 has a more preferred flexibility and softness, thus the signal transmission line 10 is more easily wound. Furthermore, the signal transmission line is more easily welded to or pressed into a terminal without breaking. Meanwhile, since the cooper wires 2 are used directly, no further finishing is required to form a flat copper foil. Thus, the whole cost is reduced and the conductivity of the copper wires 2 is improved while the resistance of the wire is stable, so as to have a good conductivity and transmission effect.

In summary, by the improved structure of a signal transmission line 10 according to the present invention, many defects in the prior art signal transmission line 20 are improved. Although the present invention has been described using specified embodiment, the examples are meant to be illustrative and not restrictive. It is clear that many other variations would be possible without departing from the basic approach, demonstrated in the present invention.

What is claimed is:

1. A signal transmission line comprising:

a plurality of substantially linearly extending cables, each of said cables being formed of a plurality of filaments having a composition selected from the group consisting of nylon and polyamide;

a plurality of copper wires respectively helically wound on said plurality of cables, each of said plurality of copper wires having a circular cross-sectional contour and being wrapped around a respective plurality of said filaments in contiguous helicals;

a pair of signal plugs respectively coupled to opposing ends of said transmission line for connection to telephone equipment; and, an insulating member encompassing said plurality of copper wires and said plurality of cables throughout a substantial length thereof, said insulating member being formed of a nylon elastomer.

* * * * *